United States Patent [19]

Grose

[11] Patent Number: 4,637,219

[45] Date of Patent: Jan. 20, 1987

[54] PEAK SHAVING SYSTEM FOR AIR CONDITIONING

[75] Inventor: Ronald D. Grose, Omaha, Nebr.

[73] Assignee: Enron Corp., Houston, Tex.

[21] Appl. No.: 854,910

[22] Filed: Apr. 23, 1986

[51] Int. Cl.[4] ..... F25B 5/00; F24D 11/00

[52] U.S. Cl. ..... 62/199; 62/117; 62/430; 165/18

[58] Field of Search ..... 62/199, 117, 201, 430; 165/18

[56] References Cited

U.S. PATENT DOCUMENTS 2,308,079 1/1943 Henney ..... 62/430

2,515,825 7/1950 Grant ..... 62/117

3,773,031 11/1973 Laing et al. ..... 126/400

4,240,268 12/1980 Yuan ..... 165/10

4,346,569 8/1982 Yuan ..... 62/260

*Primary Examiner*—William E. Wayner

*Attorney, Agent, or Firm*—Donald F. Haas

[57] ABSTRACT

The present invention provides a system and method for peak shaving for a conventional air conditioning system. Heat energy is removed from an energy storage medium during periods of low power consumption and then the storage medium is used to absorb heat energy from the refrigerant during periods of peak energy consumption.

2 Claims, 1 Drawing Figure

PEAK SHAVING SYSTEM FOR AIR CONDITIONING

BACKGROUND OF THE INVENTION

The present invention relates to an improvement in the standard air conditioning system by using an energy or heat storage medium to provide peak shaving for reduction of power consumption at times of peak usage of the air conditioning system.

The conventional air conditioning system utilizes a compressor to compress cold, low pressure refrigerant gas to hot, high pressure gas. Next, a condenser removes much of the heat in the gas and discharges it to the atmosphere. The refrigerant comes out of the condenser as a warm, high pressure liquid which flows to an evaporator where heat from the structure to be cooled is used to evaporate the gas, thus cooling the house. The cold, low pressure gas is then recycled to the compressor. Peak usage conditions for air conditioners generally come at times when the outside temperature is very high. At such times, it is difficult for the condenser to reject internal heat to the atmosphere. The air conditioning system must be designed to accommodate high power consumption in the compressor during such periods of peak usage. The present invention provides a way to reduce the designed power-consumption capacity of the compressor through the use of an energy storage medium.

SUMMARY OF THE INVENTION

The present invention is an improvement upon the conventional air conditioning system which comprises a compressor to compress cold, low pressure refrigerant gas to hot, high pressure gas, a condenser to remove heat from the hot, high pressure gas and condense it to a warm, high pressure liquid, and an evaporator to evaporate the liquid to a cold, low pressure gas for recycle to the compressor. The improvement is a peak shaving system which includes means for storing a medium from which heat can be extracted and in which heat can be stored. The system also includes a first control valve for optionally diverting the flow of the refrigerant from the condenser to a first expansion valve and then to the evaporator and directing the refrigerant instead to the storage means. A second control valve is also included for optionally diverting the flow of the refrigerant from the first control valve through a second expansion valve before the refrigerant reaches the storage means or for bypassing the second expansion valve and allowing the refrigerant to flow directly to the storage means. Finally, the system includes a third control valve for optionally directing the flow of the refrigerant from the storage means to the compressor or through a third expansion valve to the evaporator.

The method of the present invention comprises a means for removing heat energy from the storage medium (or storing "cool" therein) at times of low usage of the system by directing the refrigerant to flow through the first control valve through the second control valve and the first expansion valve to the storage means and absorb heat energy therefrom. The refrigerant then flows back through the third control valve to the compressor and on to the condenser where this heat energy is rejected to the atmosphere when the outside temperature is relatively cool, such as at night. At times of peak usage, the refrigerant from the condenser is directed through the first control valve and the second control valve causes it to bypass the second expansion valve and go directly to the storage means where the storage medium absorbs heat energy from the refrigerant. The refrigerant then flows to the third control valve which directs it through the third expansion valve to the evaporator from whence it flows back to the compressor and on to the condenser.

DETAILED DESCRIPTION OF THE INVENTION

Figure 1:
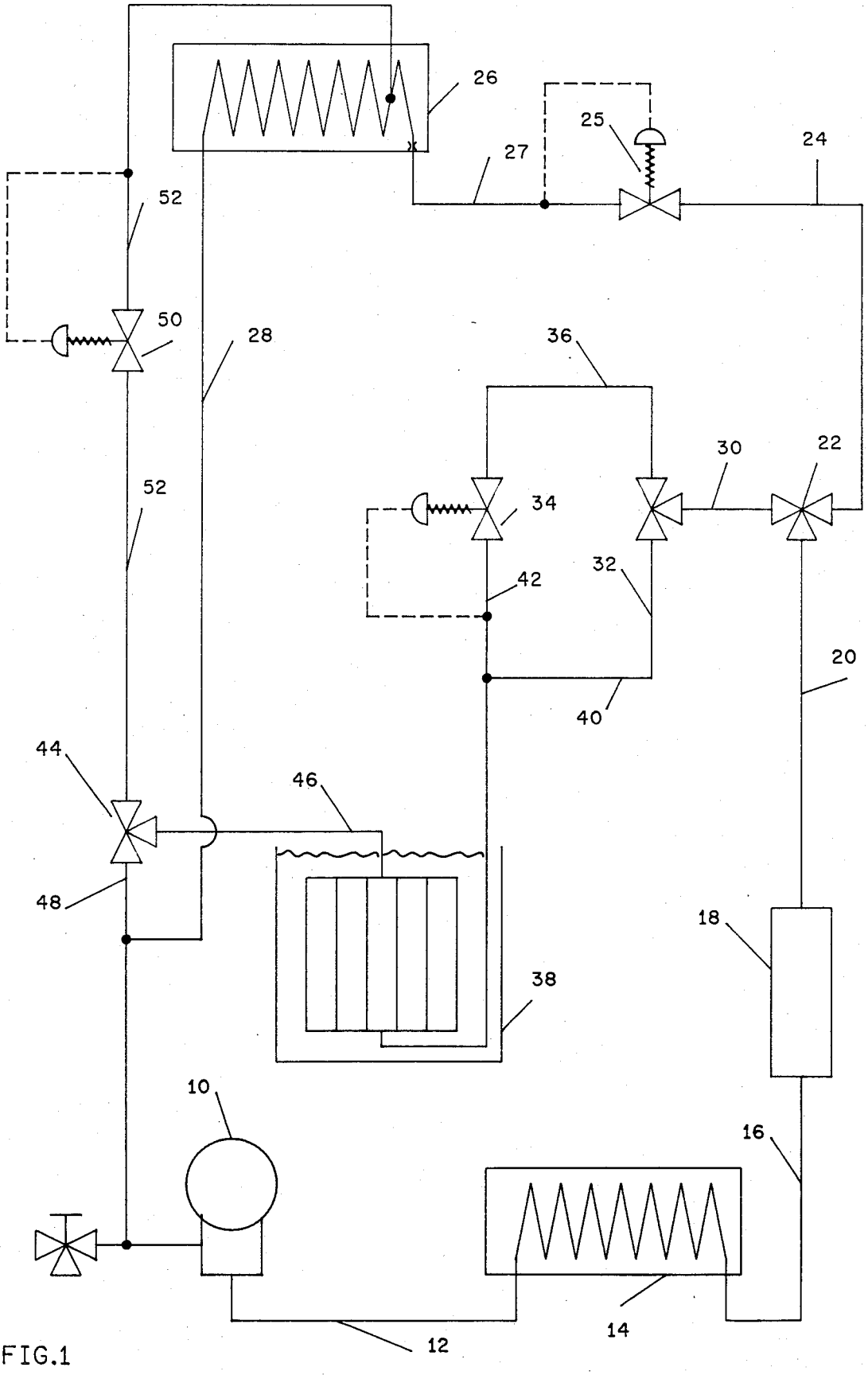
FIG. 1 is a schematic drawing of the system of the present invention.

The purpose of the present invention is to provide peak shaving for the conventional air conditioning system. Peak shaving in this case means the ability to reduce the power consumption which is necessary during periods of peak loads which generally occur when the outside temperature is very high such as in the late afternoon. The essence of the advantage which the present system provides over the standard air conditioning system is that when the peak shaving system is in operation, the refrigerant is condensed in the storage medium rather than in the condenser which is at a high outside temperature. This requires less power and the equipment for the air conditioner can be designed to provide less power and as such, be constructed more cheaply. In other words, one can obtain the same or greater cooling capacity with this system as with the standard air conditioning system while using considerably less power.

The refrigerant can be any commonly used refrigerant material such as chlorodifluoromethane Freon R-22. The storage medium can be a phase change material such as polyethylene glycol, certain salt hydrates, water, certain hydrocarbons or waxes or it can simply be a material which is capable of storing heat energy without going through a phase change such as water.

FIG. 1 illustrates the present invention and shown there is compressor 10 connected by line 12 to condenser 14 which is connected by line 16 to the filter dryer 18. The filter dryer 18 takes out any water and/or solids which may be present in the refrigerant. The filter dryer 18 is connected by line 20 to the first control valve 22. Line 24 connects the first control valve 22 to first expansion valve 25. Line 27 connects first expansion valve 25 to the evaporator 26. Line 28 then connects the evaporator 26 to the compressor 10. Control valve 22 is also connected by line 30 to the second control valve 32 which is connected on one side to the second expansion valve 34 by line 36 and on the other side to the storage means 38 by line 40. Refrigerant can flow from the expansion valve 34 through line 42 into line 40. The expansion valve 34 reduces the refrigerant pressure to its boiling point at the desired refrigeration temperature and thereby extracts heat from the storage means. A second expansion valve is required because different operating characteristics and control means are required from that used in the first expansion valve. The storage means 38 is connected to the third control valve 44 by line 46. Control valve 44 can direct refrigerant into line 28 and on to compressor 10 through line 48 or to the third expansion valve 50 through line 52. The third expansion valve 50 is needed because it does not reduce the pressure as much as the first and second expansion valves and is controlled by a different means.

In that case, the refrigerant flows from the pressure valve 50 to the evaporator 26 through line 54.

The standard air conditioning system operation mode will generally be used when the outside temperature is less than about 85° F. In this instance, cold, low pressure refrigerant is compressed by the compressor 10 and flows to the condenser 14 which takes the hot, high pressure gas and removes heat therefrom which is discharged to the atmosphere. The refrigerant comes out as a high pressure warm liquid which flows through the filter dryer 18 to the first control valve 22 which is set to direct the flow of the refrigerant directly to the evaporator 26. There the refrigerant liquid is evaporated using heat energy from the structure to be cooled and the cold, low pressure gas created thereby flows back to the compressor 10.

The second mode of operation is that of storing "cool". In this mode, which normally takes place during periods of low usage such as at night, heat energy is removed from the energy storage medium in the storage means 38. The mode of operation is the same as above up to the point where the warm, high pressure liquid refrigerant enters control valve 22. In the mode, control valve 22 is set to direct the refrigerant to flow to control valve 32 which is set to cause the refrigerant to flow through expansion valve 34 into storage means 38. Heat energy is extracted from the storage medium in the storage means 38 to evaporate the liquid refrigerant. The cold, low pressure gas from the storage means 38 then flows to the third control valve 44 which is set to cause the refrigerant to flow directly back to the compresssor 10. By this means, a great amount of heat energy can be extracted from the storage medium and, for some materials, this can cause the storage medium to solidify. Such is the case with water and ice.

The third mode of operation occurs during periods of peak power usage when the outside temperature is very high. In this case, because the compressor discharge pressure is intentionally low, the condenser 14 does not perform efficiently and the refrigerant leaving the condenser 14 is a relatively hot gas. Again, control valve 22 is set to cause the refrigerant to flow to the storage means 38 through control valve 32. However, control valve 32 this time is set to cause the refrigerant to bypass the expansion valve 34 and go directly into the storage means 38. The cold storage medium absorbs heat energy from the hot refrigerant gas, condensing it, and holds the heat energy within the storage means 38. High pressure warm liquid refrigerant leaves the storage means 38 and flows to control valve 44 which this time is set to cause the refrigerant to flow through the expansion valve 50 and into the evaporator 26 where it is evaporated using heat energy from the structure to be cooled. The cold, low pressure gas then flows back to the condenser 10 for recycle.

I claim:

1. In an air conditioning system which comprises a compressor to compress a refrigerant, a condenser to remove heat from the refrigerant and condense it, and an evaporator to evaporate the refrigerant for recycle to the compressor, the improvement which comprises a peak shaving system comprising:

(a) means for storing a medium from which heat can be extracted and in which heat can be stored, (b) a first control valve for optionally diverting the flow of the refrigerant from the condenser to the first expansion valve and into the evaporator or directing the refrigerant instead to the storage means, (c) a second control valve for optionally directing the flow of the refrigerant from the first control valve through a second expansion valve before the refrigerant reaches the storage means or bypassing the second expansion valve, and (d) a third constant valve for optionally directing the flow of the refrigerant from the storage means to the compressor or through a third expansion valve to the evaporator.

2. A method for providing peak shaving for air conditioning utilizing the system of claim 1 by:

(a) removing heat energy from the storage medium during periods of low usage by setting the first and second control valves such that the refrigerant flows from the condenser through the second expansion valve and into the storage means where it removes the heat energy from the storage medium and also setting the third control valve so that the refrigerant from the storage means flows directly back to the condenser, and (b) providing peak shaving during periods of peak usage by setting the first and second control valves to direct the refrigerant from the condenser, bypassing the second expansion valve, to the storage means wherein the cold storage medium absorbs heat energy from the refrigerant, and setting the third control valve to direct the refrigerant from the storage means through the third expansion valve to the evaporator.

* * * * *